US008376027B2

(12) United States Patent
Nakamura et al.

(10) Patent No.: US 8,376,027 B2
(45) Date of Patent: Feb. 19, 2013

(54) CORE FOR THIN-WALL HOLLOW CASTING AND THIN-WALL HOLLOW CASTING PRODUCED BY PRODUCTION METHOD EMPLOYING IT

(75) Inventors: Kazuo Nakamura, Niigata (JP); Keiichi Maekawa, Saitama (JP)

(73) Assignees: Kabushiki Kaisha Riken, Tokyo (JP); Riken Castec Co., Ltd., Kashiwazaki-Shi (JP); Honda Motor Co., Ltd., Tokyo (JP)

( * ) Notice: Subject to any disclaimer, the term of this patent is extended or adjusted under 35 U.S.C. 154(b) by 35 days.

(21) Appl. No.: 12/528,835

(22) PCT Filed: Feb. 27, 2008

(86) PCT No.: PCT/JP2008/053416

§ 371 (c)(1),
(2), (4) Date: Jan. 25, 2010

(87) PCT Pub. No.: WO2008/105461

PCT Pub. Date: Sep. 4, 2008

(65) Prior Publication Data

US 2010/0139586 A1 Jun. 10, 2010

(30) Foreign Application Priority Data

Feb. 28, 2007 (JP) ..... 2007-048921

(51) Int. Cl.
*B22C 9/10* (2006.01)
*B22C 21/14* (2006.01)

(52) U.S. Cl. ..... 164/369; 164/398

(58) Field of Classification Search ..... 164/30, 164/340, 369–370, 137
See application file for complete search history.

(56) References Cited

FOREIGN PATENT DOCUMENTS

| | | | |
|---|---|---|---|
| GB | 188137 | A | 11/1922 |
| JP | 6-8243 | Y2 | 3/1994 |
| JP | 2004-66249 | A | 3/2004 |
| JP | 2006-46280 | A | 2/2006 |
| JP | 2006-102750 | A | 4/2006 |

OTHER PUBLICATIONS

Extended European Search Report for Application No. 08712038.2 dated May 13, 2011.

*Primary Examiner* — Kuang Lin
(74) *Attorney, Agent, or Firm* — Birch, Stewart, Kolasch & Birch, LLP

(57) ABSTRACT

It is a technical common knowledge that a chaplet used in casting of a hollow casting is fusion-bonded with the melt and is incorporated into the casting. However, the adhesion between the chaplet and the casting body is not necessarily satisfactory, thereby incurring the strength reduction of a thin-wall hollow casting. A core for a thin-wall hollow casting according to the present invention is provided with a chaplet mounted thereon. The chaplet has arcuate portion 2 with a gap 5 and a plurality of projections 4 from an outer peripheral of the arcuate portion and is in contact with an inner wall 7 of a mold. The entire arcuate portion of the chaplet is included in a groove 6 formed around an outer peripheral portion of the core body. Only the projections 4 of the chaplet protrude from the core body, when the chaplet is inserted in the groove.

7 Claims, 4 Drawing Sheets

CORE FOR THIN-WALL HOLLOW CASTING AND THIN-WALL HOLLOW CASTING PRODUCED BY PRODUCTION METHOD EMPLOYING IT

TECHNICAL FIELD

The present invention relates to a core fitted with a chaplet or a core supporter used for producing a thin-wall hollow casting. The present invention also relates to a thin-wall hollow casting produced by a method using the core.

BACKGROUND OF INVENTION

In casting production, a cavity is usually formed in a casting by means of a core, in order to reduce its weight. For example, a camshaft, a crank shaft, and the like, which are the constituent parts of an automobile engine, have conventionally been solid but have recently adopted a hollow structure. The cavity of a casting is formed by a core, thereby attaining a considerable weight reduction. Since a camshaft, a crank shaft, or the like has a long overall length, a long core must be used. When a long core is set on a mold, the core may deflect or be broken due to its length and weight. When melt is poured, a core undergoes buoyancy of the melt and floats in the mold, with the result that wall thickness of a casting becomes non-uniform. Alternatively, the core is broken, thereby making it impossible to obtain a product.

Chaplets having various shapes are used as a countermeasure to cope with the above-described problems.

Non-Patent Document 1 describes that the functions of a chaplet are as follows. (1) A chaplet supports the weight of a core and maintains its size. (2) A core may float under the pressure of melt during casting; a chaplet is resistant against the core floating. (3) A chaplet withstands until a casting solidifies somewhat and hence prevents displacement of a core. (4) A chaplet is desirably fusion-bonded with the melt and is incorporated into the casting. These functions of a chaplet are matters of common technical knowledge for a person skilled in the art.

Patent Document 1 discloses production of a long casting, such as a camshaft or a crank shaft by using a core and a chaplet. An annular chaplet body extends around the outer periphery of a core except for a gap that also extends around the outer periphery of a core. Legs of the chaplet radially extend from the chaplet body. The chaplet is engaged on and is brought into contact with the wall of a mold. The chaplet is incorporated into a workpiece upon solidification of melt.

In addition, Patent Document 2 discloses a mounting structure of a chaplet. According to this structure, a chaplet body consists of one wire and is inserted in a groove of a core, and a plurality of contact parts extend radially from the chaplet body, and are engaged on and brought into contact with the wall of a mold. An aperture is formed between a pair of the contact parts. The groove of a core consists of an insertion portion of a chaplet and a fixing part for axially displacing and fixing the chaplet.

Non-Patent Document 1: Lecture of Metal Engineering 5, Working Edition, edited by Yunoshin Imai, Asakura Bookstore, published on Feb. 15, 1972, pages 124-125

Patent Document 1: Japanese Published Patent Application (kokai) No. 2004-66429

Patent Document 2: Japanese Published Patent Application (kokai) No. 2006-102750

DISCLOSURE OF INVENTION

Problems to be Solved by the Invention

Items (1) through (3) of common technical knowledge mentioned above must be exhibited to produce a casting; otherwise no casting is produced. Meanwhile, item (4) of common technical knowledge indicates that a chaplet should be fusion-bonded with melt and incorporated into a casting. The fusion-bonded chaplet may not incur any problem in appearance but may involve a problem in reduction of mechanical strength, due to adhesion failure between the chaplet and a cast body. Patent Document 1 proposes attachment of a chaplet around the outer periphery of a core. In this proposal, since an annular chaplet body surrounding a core protrudes from the outer periphery of the core, when melt is poured into a mold to produce a thin-wall casting, the flow of melt is disturbed at the protruding parts, thereby facilitating misrun. Therefore, the casting conditions, such as pouring temperature, must be controlled within a narrow range so as to prevent misrun. In addition, when an annular chaplet body protruding from the outer periphery of a core is inserted in a casting, melt and a chaplet are brought into contact with each other at several positions such as the annular outer peripheral part and both surfaces of a chaplet. It is therefore necessary to improve adhesion between a chaplet and a cast body. In other words, the increased contact area may exert an influence upon mechanical properties, such as torsional bending strength of products; for example, a camshaft or a crank shaft.

Meanwhile, Patent Document 2 proposes formation, on a core, of a groove consisting of a chaplet-insertion portion and a chaplet-fixing portion. A chaplet consisting of a wire is inserted into the insertion portion and is then axially displaced to fix it in the fixing portion. An arcuate chaplet body protrudes out of the outer periphery of a core. In such a chaplet-mounting structure, the following inconveniences were found. Flow of melt is disturbed in a mold by the arcuate chaplet body, thereby incurring misrun. Melt intrudes into the insertion portion of a core and is then rapidly cooled in a narrow groove. Since the melt intruding there is of low heat capacity, adhesion between the chaplet and a cast body is liable to be poor. In this regard, although technical common knowledge item (4) indicates that a chaplet should be fusion-bonded with melt and be incorporated into a casting, it was found that a satisfactory result is not achieved, because the entire structure of a chaplet fails to be incorporated in a casting. Presumably, the technical common knowledge item (4) is not accomplished. An object of the present invention is to provide a core for thin-wall hollow casting, which can prevent misrun and which does not lead to degradation in mechanical properties, such as torsional bending strength. Another object of the present invention is to provide a thin-wall hollow casting produced by a production method employing the core.

Means for Solving the Problems

The present invention provides a solution to the above-described problems. The discovered solution is a result of energetic research of the present inventors and is thoroughly contradictory to technical common knowledge item (4) mentioned above. That is, the structure of a core for thin-wall hollow casting according to the present invention is characterized in that it is provided with an arcuate groove for complete insertion of an arcuate portion of a chaplet, whereby the arcuate portion of a chaplet is not incorporated in a casting. A core for thin-wall hollow casting according to the present invention is characterized in that its body mounts thereon a chaplet, which has an arcuate portion with a gap and a plurality of projections from an outer peripheral of the arcuate portion and coming into contact with an inner wall of a mold; the entire arcuate portion of the chaplet is included in a groove formed on an outer diametrical portion of the core body; and only the projections of the chaplet protrude from the core body and are engaged on and in contact with the inner wall of a mold and held by the inner wall of the mold. In the present invention, thin wall indicates that the minimum wall-thickness of the hollow portion of a casting is 5 mm or less, particularly 3 mm or less.

A core for casting a thin-wall hollow casting of the present invention may be provided with a plurality of grooves for inserting the entire arcuate or arc-shaped portion of each of a plurality of chaplets. Preferably, the diameter of the groove for inserting an arcuate portion of a chaplet is larger than the diameter of the gap of a chaplet which is not yet mounted and is hence in a free state. This dimensional relationship ensures securing of a chaplet on a core. In addition, a chaplet does not fall off the core into a mold during mounting in the mold or casting. A groove for inserting an arcuate portion of a chaplet may be formed around the entire circumference of the core or may be formed partially only to insert the arcuate potion of a chaplet. A partially circumferential groove is preferred, because the chaplet's rotational slippage around the axis of a core body can be prevented and the chaplet is reliably fixed.

In a method for producing a thin-wall hollow casting according to the present invention, a chaplet having an arcuate portion with a gap and a plurality of projections extending from the outer peripheral portion of the arcuate portion is mounted on a core, and the projections are in contact with the inner wall of a mold. Only the projections of a chaplet protrude from the core and the entire arcuate portion of the chaplet is included in the groove formed around the outer peripheral portion of the core body. The casting method is characterized in that melt in a mold which supports the core.

A thin-wall hollow casting produced by the production method using a core for casting a thin-wall hollow casting according to the present invention consists of a long cast body with a cavity, a chaplet having an arcuate portion with a gap and a plurality of projections extending from the outer peripheral arcuate portion of the chaplet to the outermost peripheral portion of the cast body. A characteristic of the casting resides in that the projections are included in the cast body and the arcuate portion of a chaplet protrudes into the cavity. The thin-wall hollow casting is preferably used for a camshaft of an internal combustion engine.

Effects of the Invention

The core body of a core for thin-wall hollow casting according to the present invention has, on an outer diametrical portion thereof, a groove for inserting and including the entire arcuate portion of a chaplet. A chaplet is mounted in the groove in such a manner that only the projections thereof protrude out of the core body. Although melt flow is subjected to disturbance by the chaplet during casting, since only the projections protrude out of the core body, such disturbance is slight. Occurrence of misrun can also be prevented even if the casting conditions are not controlled within a narrow range. A portion of a chaplet, which is inserted in the cast body, is limited to a small size, and therefore the contact area between the cast body and the chaplet's contact portion is also small. Accordingly, mechanical strength, such as a torsional bending strength of the thus-produced thin-wall hollow casting, can be maintained at a satisfactorily high level.

Furthermore, since the entire arcuate portion of the chaplet is included in a core, when a core is located on the mold or when the casting is carried out, the chaplet neither falls off into a mold nor slips axially. For these reasons, a cavity having high dimensional accuracy can be formed. Particularly, the core for thin-wall hollow casting can be advantageously employed for producing a thin-wall hollow casting having a long bar form, such as a camshaft or the like.

In addition, when a thin-wall casting is produced by means of a core according to the present invention, misrun can be prevented, satisfactorily high mechanical strength can be ensured, and reduction of wall-thickness and weight is easy. Also, the projections of a chaplet are inserted into a casting at the end of a casting operation. When a thin-wall hollow casting is produced by the above-described method using the core of the present invention, the contact area between the chaplet and the cast body is reduced such that satisfactorily high strength can be ensured notwithstanding a thin wall-thickness.

The present invention is explained in more detail with reference to the drawings.

Embodiments of the present invention are explained.

FIG. 1 schematically illustrates a cross section of a mold, in which a core for a thin-wall hollow casting according to the present invention is assembled. A chaplet 1 mounted on a core body is in the form of a sheet including an arcuate portion 2 larger than a semi-circle, and a gap 3 is formed between the two ends of the arcuate portion 2. The arcuate portion 2 is provided with projections 4 (4*a*, 4*b*, 4*c*) at three positions; that is, the two ends and the center of thereof. The projections 4 are extended diametrically to the inner wall of molds 7, 8, and are brought into contact with the molds at engagement portions 9 (9*a*, 9*b*, 9*c*). An optional number of the projections 4 may be provided on an optional position of the arcuate portion 2. Preferably, the projections are provided at the three positions; i.e., the center and both ends of the of the arcuate portion. As is illustrated in FIG. 2, one or more grooves 6 are formed on a core body 5, so that the arcuate portion 2 of a chaplet 1 is completely inserted and included in the groove (s).

An optional number of the grooves 6 are provided on the core body 5 with an optional distance therebetween and are preferably distributed over the entire length of the core body 5. The diameter 10 of a groove 6 formed on the core body 5 is larger than the length of the gap 3 of the chaplet 1. Therefore, when the chaplet 1 is mounted on the groove 6 of the core body 5, the gap 3 of the chaplet 1 is expanded due to elastic deformation of the chaplet 1. The chaplet 1 mounted in the groove 6 grasps the core body 5 and is fixed in the groove 6 inseparably from the core body 5. The groove 6 can be formed on the entire outer periphery of the core body 5. FIG. 3 illustrates an embodiment of a core for a thin-wall hollow casting, in which the grooves 6 of the core body 5 are formed around the entire circumference of the core body 5. The chaplet 1 is mounted on the grooves 6, which are formed on the entire circumference of a core body 5. FIG. 4 is a cross section taken along line IV-IV of a core for a thin-wall hollow casting shown in FIG. 3, as viewed in the direction of the arrows shown in FIG. 3. The projections 4 (4*c* in FIG. 3) of the chaplet 1 mounted in the grooves may be axially aligned, or may be non-aligned. In the latter case, the projection-positions on an outer diametrical position of a core body 5 are varied. A combination of different chaplets 1 having various positions of projections 4 and gaps 3 may also be used. Preferably, chaplets 1 having projections 4 and gaps 3 of identical shapes are used, and the projections 4 and gap are axially aligned, so that the chaplet 1 can be easily mounted.

A core for casting a thin-wall hollow casting according to the present invention has the following structure. The arcuate portion 2 of the chaplet 1 is completely included in the groove 6 of the core body 5. Only the projections 4 of the chaplet 1 protrude diametrically from the outer peripheral of the core body 5. The groove 6 may be formed partially on only a part of the outer periphery of the core body 5, so as to include the chaplet 1 in the groove 6. Then, when a core is located in a mold, or when casting is carried out, positional slippage in a rotational direction can be advantageously prevented. In FIG. 1, the arcuate portion 2 of the chaplet 1 and the projections 4 are of identical widths (thicknesses). However, these widths (thicknesses) may be different from one another. Preferably, the width of the projections 4 is desirably as thin as possible, so that they can be easily inserted in the cast body and melt can flow smoothly. A front end of the projections may have a stepped, narrower width.

When the chaplet 1 having the gap 3 is mounted in a groove of a core for thin-wall hollow casting according to the present invention, the gap 3 is expanded by elastic deformation. The chaplet 1 may be made of any appropriate material which enables expanding the gap, fixing of the chaplet in the groove 6 grasped by the chaplet 1. Materials having excellent spring properties, such as carbon tool-steel (SK material) and stainless steel (SUS) stipulated in JIS standards, can be used. For example, a rolled sheet of the above material is blanked or fusion-cut by laser-beam scanning into a form of a chaplet. Carbon tool-steel may be hardened by quenching. The chaplet 1 may be nickel (Ni)- or tin (Sn)-plated so as to enhance the fusion-boding property at the interface between melt and chaplet 1 and also so as to provide rust-proofing of the chaplet.

The core body 5 can be manufactured by such molding methods as shell molding and a cold box method. Sand used for molding may be natural silica sand, or a mullite-based artificial refractory sand. Preferably, sand having fine particle diameter is blown by a sand-blowing-type shell molding. In this case, a thin groove can be easily formed with the use of fine-particle sand, and the sand is blown with enhanced flowability.

When a core for casting a thin-wall hollow casting according to the present invention is held at a predetermined position of the mold, the projections 4*a*, 4*b* of a chaplet 1 are engaged on and brought into contact with inner walls 9*a*, 9*b* of the mold (lower mold) 8, as shown in FIG. 1. The core does not deflect by its own weight. A mold (upper mold) 7 is located on and covers the mold (lower mold) 8 set above. The projection 4*c* is engaged on and brought into contact with the inner wall 9*c* of the mold (upper wall) 7. Melt 11 is poured into the mold, in which a core is located as described above. Then, the melt level rises upward from the lower mold 8 and imparts buoyancy to the core. The core withstands buoyancy and can be held at a predetermined position.

When melt is poured to produce a casting of a thin-wall casting, particularly a thin-wall casting, a thin-wall portion of which has a minimum wall thickness of 3 mm or less, melt is intensely cooled by the mold, thereby impairing flowability. The flow of the melt may be disturbed, when the arcuate portion 2 of the chaplet 1 protrudes from the core body 5. On the other hand, since the arcuate portion 2 of the chaplet 1 is completely included in the groove of a core body of a core for casting thin-wall hollow casting according to the present invention, a portion of the chaplet 1 inserted in the cast body is limited to the projections 4. An influence of the inserted portion upon impeding flowability is therefore suppressed to a minimum extent. The projections 4 inserted in the melt remain un-dissolved when the melt completely fills the mold interior. Therefore, the projections 4 and the arcuate portion 2 hold the core body 5 at a highly accurate position in the mold.

BEST MODE FOR CARRYING OUT THE INVENTION

The present invention is explained in further detail with reference to the drawings examples, which are not at all limitative to the present invention.

Example 1

Figure 1:
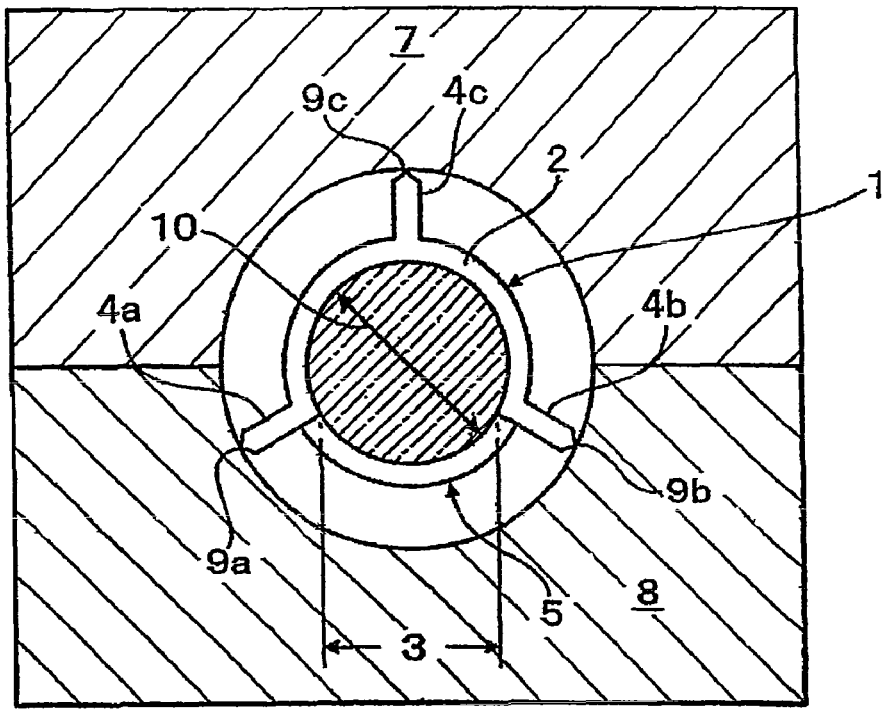
FIG. 1 a schematic cross sectional drawing of a mold, in which a core for thin-wall hollow casting according to the present invention is located.
Figure 2:
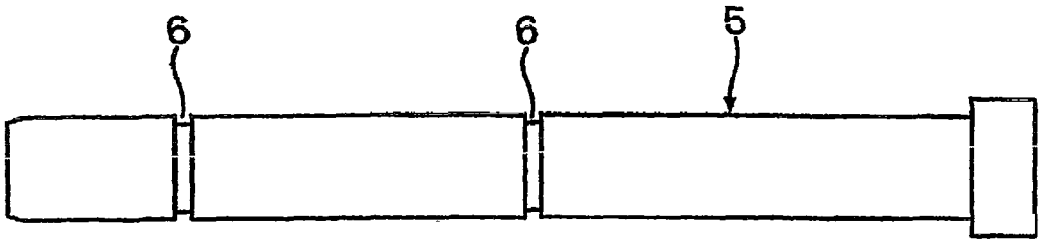
FIG. 2 a front view of a core body for a thin-wall hollow casting according to an example of the present invention.
Figure 3:
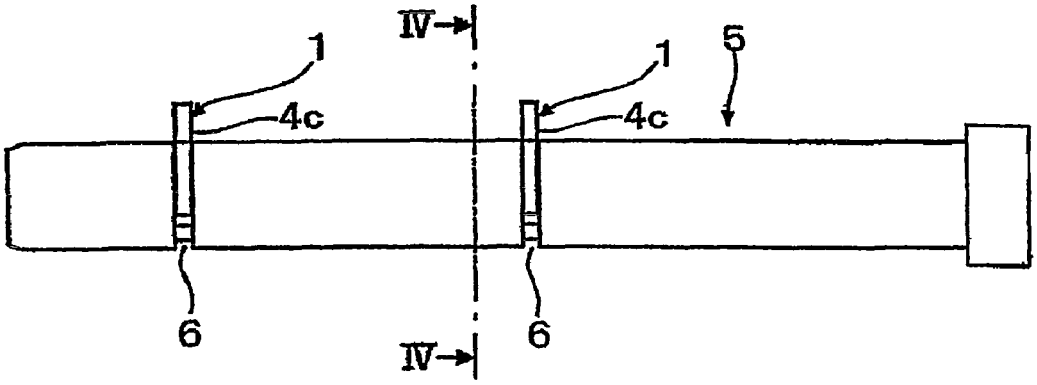
FIG. 3 a front view of a core for thin-wall hollow casting according to the present invention shown in FIG. 2, in which a chaplet is mounted.
Figure 4:
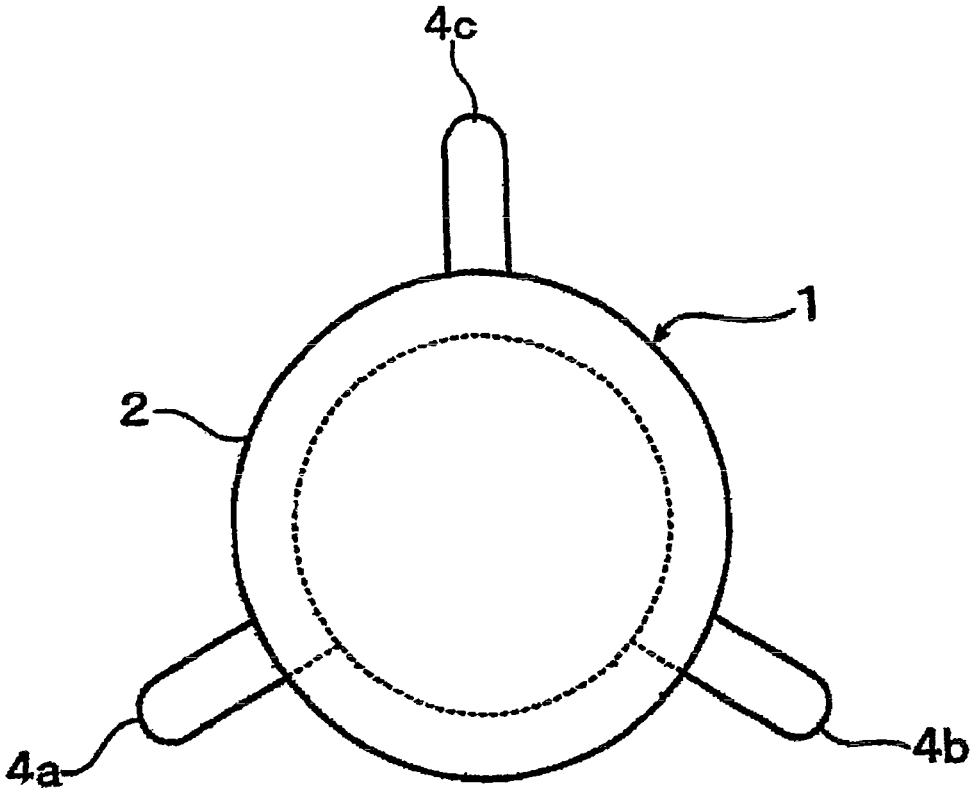
FIG. 4 a cross sectional drawing along IV-IV of FIG. 3.

As shown in FIG. 1, a chaplet 1 in the form of a sheet has an arcuate portion 2 larger than a semi circle, and a gap 3 between the two ends of the arcuate portion 2. Projections 4*a*, 4*b*, 4*c* are formed at three positions; that is, at the two ends and the center of the arcuate portion 2. The projections 4*a*, 4*b*, and 4*c* are diametrically extended. The chaplet 1 was formed by blanking a 0.8-mm thick rolled sheet of SK material (JIS Standard). The press-formed chaplet was hardened by quenching at 830 degrees C. and was then subjected to electrolytic nickel plating to form a 2-3 μm thick nickel coating. Mullite-based artificial refractory sand was coated with phenol resin. The thus-prepared resin coated sand was blown into a heated core-forming mold by a shell molding process. A core body 5 was thus manufactured. Grooves 6 for including the entire arcuate portion 2 of the chaplet 1 were formed around the entire periphery of the core body 5.

Figure 5:
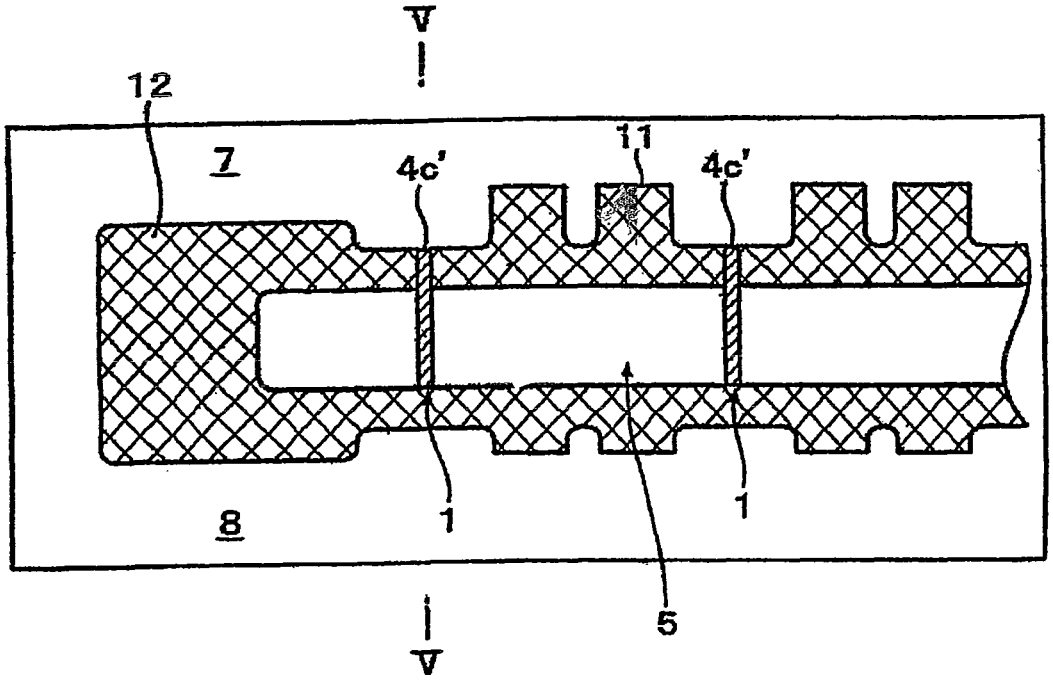
FIG. 5 a schematic drawing illustrating a casting method using a core for a thin-wall hollow casting of Example 1.
Figure 6:
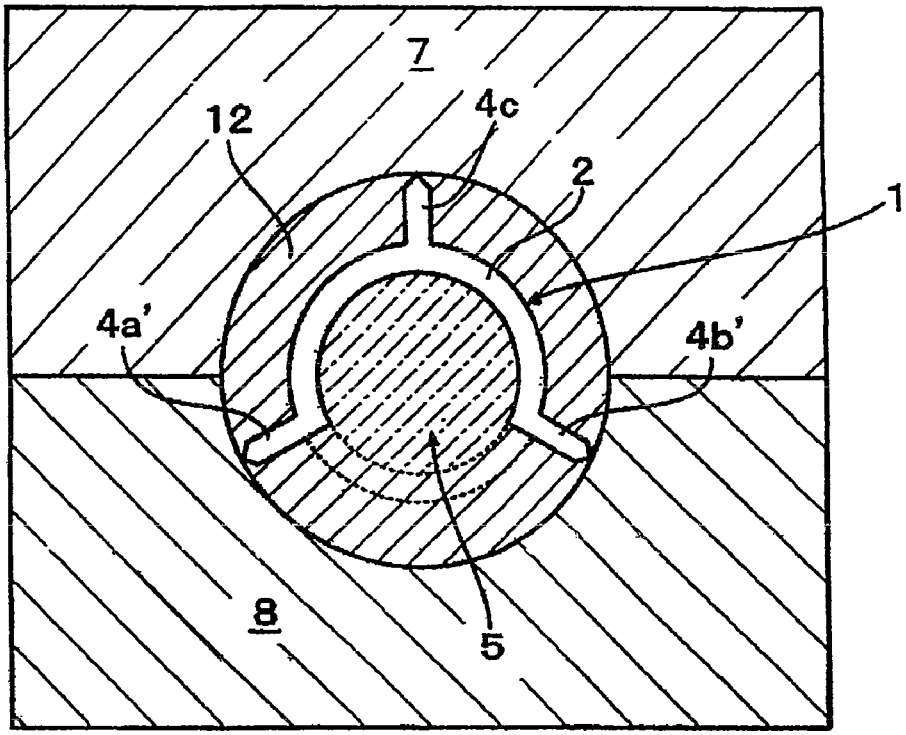
FIG. 6 a schematic cross section of V-V of FIG. 5.

The chaplet 1 was subjected to elastic deformation to expand its gap 3 and was then mounted in the grooves 6 around the entire periphery of the core body 5 mentioned above. A camshaft produced in Example has thin journal potions. The grooves 6 for mounting the chaplet are formed at two positions of the core body 5 corresponding to the thin wall or journals of a camshaft. A thin-wall hollow casting; that is, a camshaft having a hollow axial structure of an automobile engine, is produced by means of the core produced as above. The core for casting a thin-wall hollow casting was located as shown in FIG. 1. Projections 4*a*, 4*b* from both ends of the arcuate portion 4 are engaged on and brought into contact with the portions 9*a*, 9*b* on inner walls of a mold (lower mold) 8. A mold (upper mold) 7 is located on and covers the mold (lower mold) 8 set above. The projection 4*c* is engaged on and is brought into contact with the portion 9*c* of the inner wall of the mold (upper wall) 7. Melt 11 (temperature—1350 to 1430 degrees C.) of FCD 600 (JIS Standard) was poured into the mold of ten casting frames. A thin-wall camshaft having a minimum thickness of 2.5 min was produced (FIGS. 5, 6). A camshaft of thin wall hollow casting according to Example 1 was cast by using a core for a thin-wall hollow casting according to the present invention.

In Example 1, casting of ten frames was carried out using cores for thin-wall hollow casting according to the present invention. In every frame, melt flow was not disturbed and melt run was improved. Only the projections 4 from the core body 5 were inserted in the cast body. The outer periphery of the arcuate portion 2 of the chaplet 1 was affixed on the cast body. Adherence state of interface between them was improved. The degree of concentricity and dimensional accuracy of the cavity were also improved.

Melt-run quality was evaluated by observing the cast camshafts with the naked eye. When melt run in all of the ten casting frames was excellent, evaluation symbol ○ was assigned as shown in Table 1. When melt run state in half or more of the ten casting frames was excellent, evaluation symbol Δ was assigned as shown in Table 1. When melt run state in all of the ten casting frames was not excellent or a core was broken, evaluation symbol X was assigned as shown in Table 1. As described above, three-level evaluation was made. Observation with the naked eye revealed that melt-flow disturbance and the resultant misrun occurred mainly at the circumference of projections of a chaplet. A cast camshaft was shaved by a turning machine so as to expose the chaplet. The interface between the chaplet and cast metal was examined by the naked eye and by a visible dye penetrating test (color check). The casting qualities were thus evaluated more strictly. The adhesion state between the chaplet and cast metal was evaluated in two levels; that is, excellent adhesion condition of the entire surfaces of (○ in Table 1), and several non adhesions (Δ in Table 1).

Example 2

Figure 7:
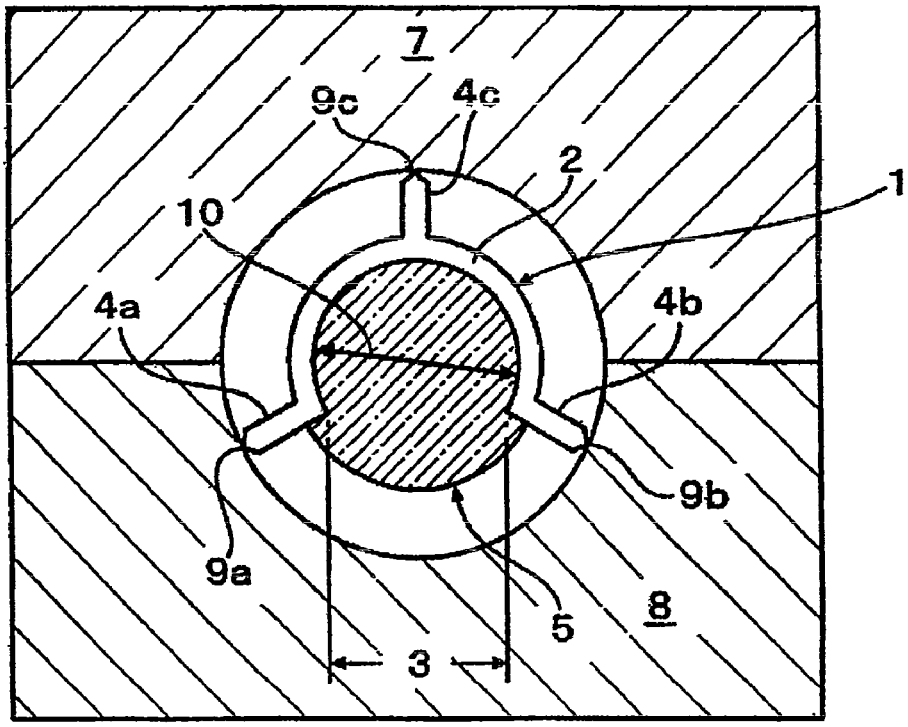
FIG. 7 a schematic cross sectional drawing of a mold, in which a core for thin-wall hollow casting according to the inventive Example 2 is located.
Figure 8:
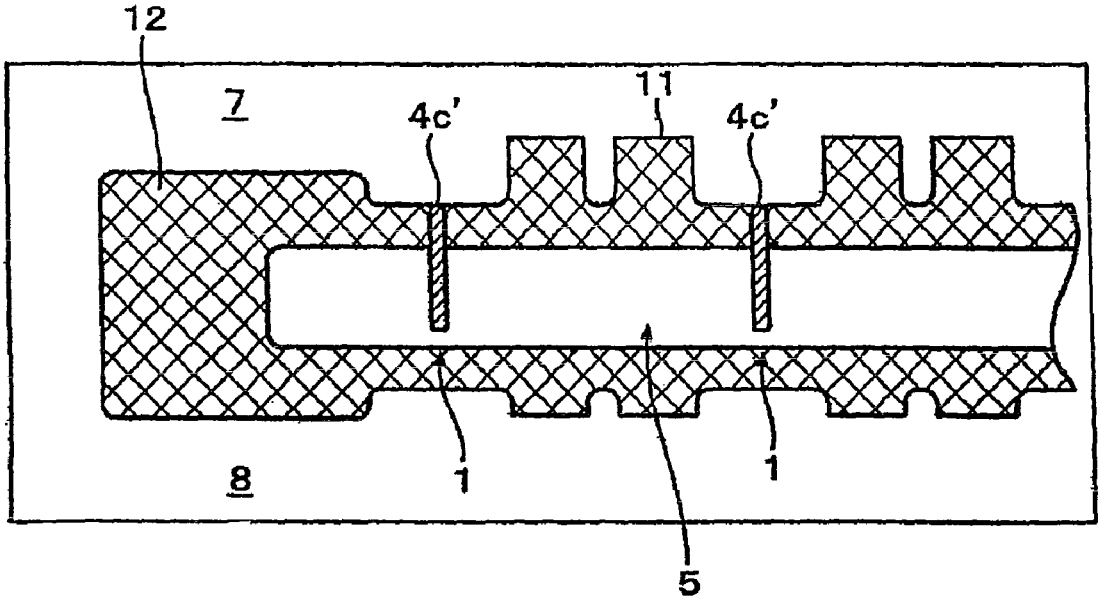
FIG. 8 a schematic drawing of casting method using a core for thin-wall hollow casting according to the inventive Example 2.

A core for thin-wall hollow casting, which was the same as that of Example 1, was manufactured, except that a groove 6 included only the arcuate portion 4 of a chaplet as shown in FIG. 7. In Example 2, this core for thin-wall hollow casting was used to cast a thin-wall hollow casting camshaft. That is, the groove 6 was formed only on a partial circumference of the core body 5. In every ten casting frames, melt flow was not disturbed and melt run state was improved. Only the projections 4 from the core body 5 were inserted in the cast body. An arcuate portion 2 of a chaplet 1 was in contact with and adhered on the cast body. A portion of the chaplet is contiguous to the cast body. Poor adhesion between the chaplet and the cast body may occur at such a portion. However, adhesion between the cast body and a chaplet contact portion was improved in the present invention, because the contiguous portion is limited. The degree of concentricity and dimensional accuracy of a cavity were also improved.

Comparative Example 1

Figure 9:
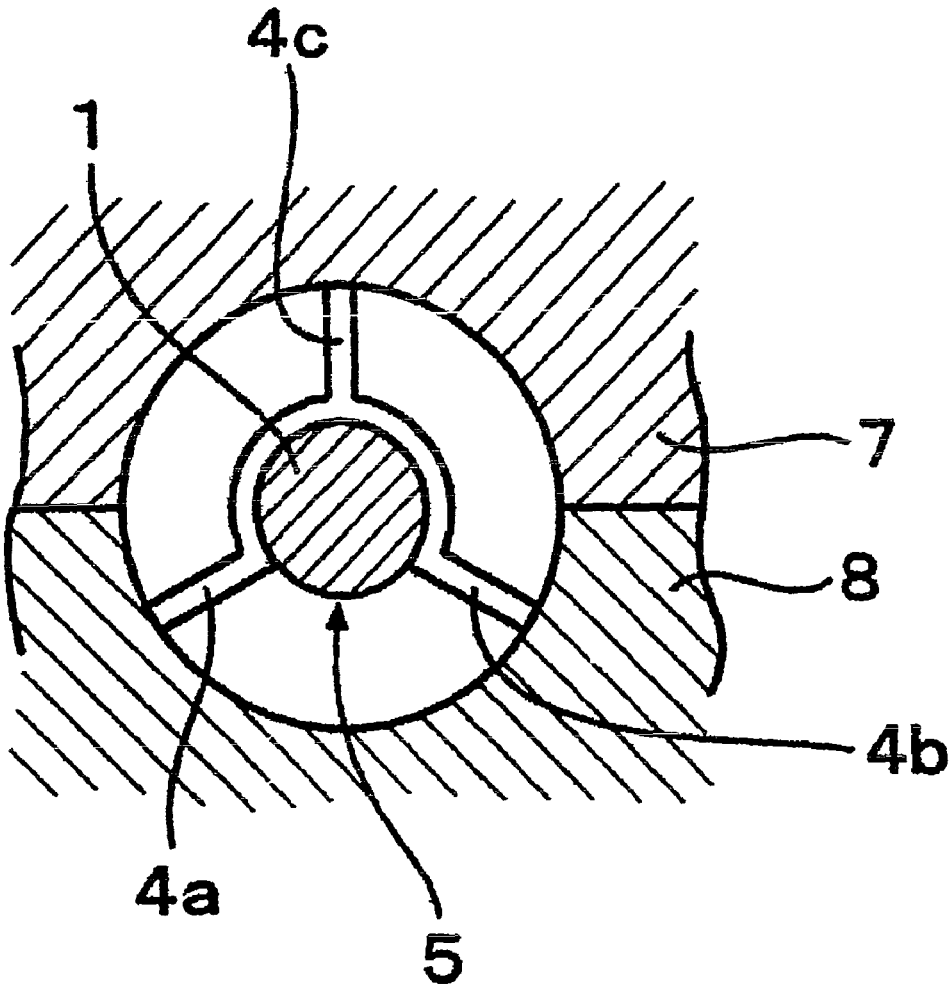
FIG. 9 a schematic cross sectional drawing of a core with a mounted chaplet according to the prior art.

In Comparative Example 1, grooves 6 are not formed on the core body 5. An arcuate portion 2 of a chaplet 1 diametrically protruded from the outer periphery of a core. Such a chaplet was mounted on a core body 5 according to a conventional technique (FIG. 9). The core for thin-wall casting was located in the molds 7, 8 as in Example 1. Melt 11 of FCD 600 (JIS Standard) was poured into the molds of ten casting frames to produce camshafts having thin-wall hollow casting structure with a minimum wall-thickness of 2.5 mm. Melt run states were excellent in eight or nine of the ten frames, in which a core for thin-wall casting was located to cast a camshaft. Melt flow was disturbed in the remaining one or two frames, and adhesion was not attained locally at the point of contact between the chaplet 1 and the core body.

Comparative Example 2

In comparative Example 2, a core for thin-wall casting was located in and fixed on the molds not by the chaplet but by a core print at one end of the core. Melt 11 of FCD600 (JIS Standard) was then poured in a mold to produce a camshaft having a thin-wall hollow structure. In the case of casting the camshafts by Comparative Example 2, all of the ten casting frames resulted in breaking or floating of cores, because they could not withstand floatation by melt. A predetermined cavity could therefore not be formed.

(Fatigue Strength Test by Torsional Bending)

Thirteen camshafts were manufactured according to Examples 1, 2 and Comparative Example 1. The camshafts measured 22 mm in outer diameter of the axial part, 17 mm in diameter of cavity, and 2.5 mm in wall thickness. These camshafts were subjected to a cantilever-type torsional-bending fatigue-strength test under the conditions of 1500 rpm and a bending stress of 330 to 450 MPa. The camshafts produced in Examples 1 and 2 did not fracture under bending stress of 350 MPa up to $10^7$ repetitions. Their strength was therefore satisfactory (○ in Table 1). The products of Comparative Example 1 exhibited different fatigue strength. A product having low fatigue strength (Δ in Table 1) locally exhibited no adhesion between a chaplet and a cast body due to disturbance of melt flow. Table 1 shows the results of Examples and Comparative Examples. As is described hereinabove, in a core for casting thin-wall hollow casting according to the present invention, since the arcuate portion 2 of a chaplet 1 is completely included in the groove of a core body, a portion of the chaplet 1 inserted in the cast body is limited to the projections. An influence of the inserted portion upon impeding flowability is therefore suppressed to a minimum extent. Strength of the camshaft is therefore improved.

TABLE 1

| | Evaluation of Melt Run State | Evaluation of Adhesion of Chaplet | Rotation Bending Strength Test |
|---|---|---|---|
| Example 1 | ○ | ○ | ○ |
| Example 2 | ○ | ○ | ○ |
| Comparative Example 1 | Δ | Δ | Δ~○ |
| Comparative Example 2 | X (Core Fracture) | — | — |

INDUSTRIAL APPLICABILITY

As is described hereinabove, a core according to the present invention can solve failures of adhesion between a chaplet and a core body, as well as a failure of melt run due to a chaplet. Therefore, a chaplet according to the present invention is appropriate for producing a thin-wall hollow casting, such as a crank shaft or a camshaft.

The invention claimed is:

1. A core for thin-wall hollow casting consisting of cast iron and having 5 mm or less of minimum thickness of a hollow portion thereof, comprising a chaplet having an arcuate portion with a gap and a plurality of projections on an outer peripheral portion of the arcuate portion, and being in contact with an inner wall of a mold, wherein an entire arcuate portion of the chaplet is included in a groove formed around an entire outer peripheral portion of a core body, and only the projections of the chaplet protrude from the core body, and are engaged on and are in contact with the inner wall of the mold and are held by the inner wall of the mold.

2. A core for thin-wall hollow casting according to claim 1, wherein a diameter of the groove formed on the core body is larger than the gap of the chaplet.

3. A method for producing a thin-wall hollow casting consisting of cast iron and having 5 mm or less of minimum thickness of a hollow portion thereof, comprising: mounting, on a casting core, a chaplet having an arcuate portion with a gap and a plurality of projections extending from an outer peripheral portion of the arcuate portion, and being in contact with an inner wall of a mold, wherein an entire arcuate portion of the chaplet is included in a groove formed around an entire outer peripheral portion of a core body, such that only the projections protrude from the core body;

holding the core in a mold by the projections; and, pouring melt of the cast iron into the mold.

4. The core for thin-wall casting according to claim 1, wherein the arcuate portion of the chaplet is not incorporated in the thin-wall hollow casting.

5. The core for thin-wall casting according to claim 2, wherein the arcuate portion of the chaplet is not incorporated in the thin-wall hollow casting.

6. The method for producing a thin-wall hollow casting according to claim 3, wherein the arcuate portion of the chaplet is not incorporated in the thin-wall hollow casting.

7. The method for producing a thin-wall hollow casting according to claim 3, wherein the arcuate portion of the chaplet is not incorporated in the thin-wall hollow casting.

* * * * *